United States Patent [19]

Palmer

[11] Patent Number: 4,529,655

[45] Date of Patent: Jul. 16, 1985

[54] INTERLACED POLYESTER INDUSTRIAL YARNS

[75] Inventor: Russell N. Palmer, Kinston, N.C.

[73] Assignee: E. I. Du Pont de Nemours and Company, Wilmington, Del.

[21] Appl. No.: 660,397

[22] Filed: Oct. 17, 1984

Related U.S. Application Data

[63] Continuation-in-part of Ser. No. 611,982, May 23, 1984, abandoned.

[51] Int. Cl.[3] ..... D02G 3/00

[52] U.S. Cl. ..... 428/399; 28/276; 57/908; 428/364

[58] Field of Search ..... 428/364, 373, 399; 57/908, 200; 28/274, 275, 276

[56] References Cited

U.S. PATENT DOCUMENTS

| | | | |
|---|---|---|---|
| 2,985,995 | 5/1961 | Bunting et al. | 57/140 |
| 3,069,836 | 12/1962 | Dahlstrom et al. | 57/157 |
| 3,083,523 | 4/1963 | Dahlstrom et al. | 57/140 |
| 3,216,187 | 11/1965 | Chantry et al. | 57/140 |
| 3,413,797 | 12/1968 | Chapman | 57/140 |
| 4,251,481 | 2/1981 | Hamlyn | 264/210 |
| 4,349,501 | 9/1982 | Hamlyn | 264/210 |

*Primary Examiner*—Lorraine T. Kendell

[57] ABSTRACT

An interlaced polyester yarn having an improved combination of low shrinkage properties and high tenacity.

11 Claims, 3 Drawing Figures

INTERLACED POLYESTER INDUSTRIAL YARNS

CROSS-REFERENCE TO RELATED APPLICATION

This application is a continuation-in-part of application Ser. No. 611,982, filed May 23, 1984, now abandoned.

DESCRIPTION

Technical Field

This invention relates to an improved continuous process for preparing improved polyester yarn having a low shrinkage and to new interlaced polyester industrial yarns having a better balance of strength and residual shrinkage. More particularly, it relates to an improvement in a coupled process of spinning, drawing, relaxing, interlacing and winding, whereby such new yarns can be produced.

Background Art

Industrial (i.e., high strength) polyester multifilament yarns are well known, e.g., from Chantry and Molini, U.S. Pat. No. 3,216,187, and have been manufactured on a large scale and used commercially for about 20 years. Typically, such industrial polyester yarns are poly(ethylene terephthalate) of denier about 800–2000 and of relative viscosity at least 35, which characteristics distinguish them from polyester apparel yarns of lower denier and lower relative viscosity, and consequently of significantly lower strength. For some purposes, it is conventional to reduce the residual shrinkage of such yarns by a relaxation treatment, i.e., by heat treatment and overfeeding the hot-drawn yarn to allow for controlled shrinkage during the heat treatment, e.g., as disclosed in Chapman, U.S. Pat. No. 3,413,797, which discloses a split process involving relaxing yarns with a low degree of twist. A more economical process, used commercially, is to couple the steps of spinning, drawing, relaxing and interlacing into a continuous process before winding the yarn to form a package. A typical interlacing process is disclosed in Bunting and Nelson, U.S. Pat. No. 2,985,995, involving the use of air jets to improve the coherency of the multifilament yarn by entangling the yarn without significantly affecting its bulk. Such interlacing jets are conventionally operated with air at room temperature for economic reasons, and because no benefit has been expected from using heated air in this coupled process.

Thus, it has been known to prepare industrial polyester yarns of somewhat low shrinkage by a continuous process involving spinning, hot-drawing, heat-relaxing, interlacing and winding the yarn to form a package in a coupled process. By adjustment of the relaxation conditions, it has been possible to adjust the properties of the resulting yarn to a limited extent only. For instance, by increasing the degree of overfeed during the relaxation, it has been possible to produce yarn of lower residual shrinkage, but hitherto this has been accompanied by a significant and undesired decrease in tenacity and modulus. What has long been desirable has been such a decrease in residual shrinkage without such a significant decrease in tenacity. This has been disclosed in Hamlyn U.S. Pat. Nos. 4,251,481 and 4,349,501, which confirm the difficulty experienced by the prior art in obtaining industrial polyester yarns of desirably low shrinkage, without sacrificing strength, by a coupled process of spinning, drawing, relaxing, interlacing and winding as a continuous operation.

Industrial polyester yarns having a better combination of tenacity and low shrinkage have been obtainable by a split process, i.e., the older 2-stage process of first spinning and winding the yarns to form a package, and then carrying out the drawing and relaxing in a separate stage and rewinding. This split process is not so economical. The properties of the resulting yarns could desirably be improved in certain respects.

It is an object of the invention to provide improved interlaced polyester industrial yarns having a better balance of properties, i.e., high strength (tenacity desirably not much below 8 gpd) together with low residual shrinkage (not more than 3.5%, desirably, and also importantly a low shrinkage tension), than have been available hitherto, by an economical process of the coupled type conventionally used hitherto. It is also an object of the invention to provide an improved process for preparing such industrial yarns by this coupled technique.

These and other objects are provided by this invention.

Disclosure of the Invention

I have now found that the use of hot air for interlacing can give advantageous results, in that the residual shrinkage can be reduced without such great loss in tenacity as has been experienced in the prior art, when cold (room temperature) air has been used in the interlacing jet.

Although the invention is not limited by any theory, it seems important to avoid cooling the hot yarn, i.e., to maintain such hot yarn at above a critical temperature, for sufficient time to allow the improved balance of properties to develop, as discussed in more detail hereafter. At this time, it is believed that, to develop the same combination of properties, it is not desirable to allow the freshly-relaxed yarn to cool to room temperature and then reheat the cold yarn.

Accordingly, this invention provides an improved process for preparing high strength polyester yarn having a low shrinkage involving the steps of spinning molten poly(ethylene terephthalate) of high relative viscosity to form a multifilament yarn, then advancing the yarn while drawing at an elevated temperature to increase its strength, followed by a step of heating the yarn and overfeeding it to reduce its shrinkage, including a step of interlacing the yarn to provide coherency, and winding the interlaced yarn at a speed of at least 1800 ypm (yards per minute), corresponding to about 1650 meters/min, to form a package in a continuous process, the improvement characterized in that the temperature of the yarn is maintained above about 90° C., preferably at about 90° to 160° C., until completing winding the yarn package.

I have found that the simplest way to achieve this improvement in properties is to carry out the interlacing step with heated air, preferably at temperatures of about 90° to 200° C., to avoid cooling the yarn as it passes to wind-up but, depending on the precise process used hitherto, other measures may be used to keep the yarn hot, and so obtain the desired reduction in shrinkage without undesired reduction in tenacity.

This invention also provides an interlaced poly(ethylene terephthalate) industrial yarn of relative viscosity at least about 35, and having a combination of high strength and low shrinkage as determined by a dry heat shrinkage $DHS_{177}$ (measured at 177° C.) of about 3.5% or less, preferably about 3.2% or less, a dry heat shrinkage $DHS_{140}$ (measured at 140° C.) of about 2.0% or less, preferably about 1.6% or less, a shrinkage tension $ST_{140}$ (measured at 140° C.) of about 0.03 gpd or less, preferably 0.02 gpd or less, a tenacity of at least about 7.7 gpd, and an elongation $E_5$ measured at a load of 2.3 gpd of no more than about 10%. Such yarns can be made of very uniform shrinkage (e.g., $DHS_{177}$) as shown by a low standard deviation, preferably about 0.30 or less, and especially about 0.20 or less. In practice it is difficult to produce yarns of satisfactory tensile properties and of extremely low shrinkage merely by the coupled process described herein, without further processing steps, so the yarns resulting from such coupled process will generally have shrinkages above the following minimums, $DHS_{177}$ 2.0%, $DHS_{140}$ 1.0% and $ST_{140}$ 0.01 gpd. Similarly practical limits for the tensile properties are maximum tenacity about 8.5 gpd and minimum $E_5$ about 8%.

Detailed Disclosure of Invention

Figure 1:
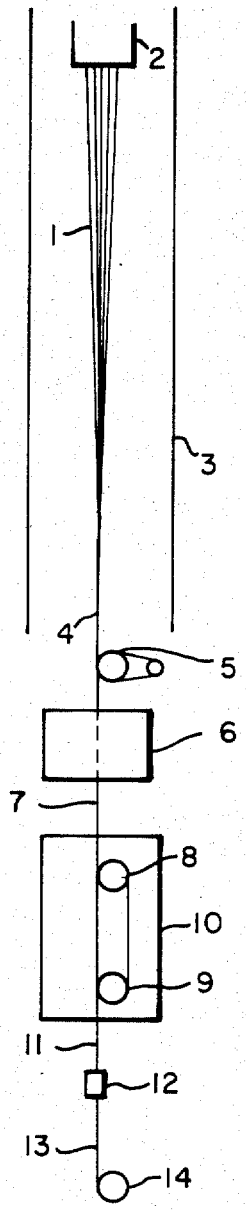
FIG. 1 schematically shows a conventional coupled process of preparing interlaced polyester industrial yarns that can be modified according to the present invention.

Referring to FIG. 1, polyester filaments 1 are melt-spun from spinneret 2, and solidify as they pass down within chimney 3 to become an undrawn multifilament yarn 4, which is advanced to the drawing stage by feed roll 5, the speed of which determines the spinning speed. i.e., the speed at which the solid filaments are withdrawn in the spinning step. The undrawn yarn 4 is advanced past heater 6, to become drawn yarn 7, by draw rolls 8 and 9, which rotate at the same speed, being higher than that of feed roll 5. The draw ratio is the ratio of the speed of draw rolls 8 and 9 to that of feed roll 5, and is generally between 4.7X and 6.4X. The drawn yarn 7 is annealed as it makes multiple passes between draw rolls 8 and 9 within heated enclosure 10. The resulting yarn 11 is interlaced as it passes through interlacing jet 12, to become interlaced yarn 13, being advanced to wind-up roll 14, where it is wound to form a yarn package. The yarn 11 is relaxed because it is overfed to wind-up roll 14, i.e., the speed of wind-up roll 14 is less than that of rolls 9 and 8. Finish is applied in conventional manner, not shown, generally being applied to undrawn yarn 4 before feed roll 5 and to drawn yarn 7 between heater 6 and heated enclosure 10. So far, a conventional coupled process has been described. Hitherto, the air used for interlacing has been cold, i.e., at about room temperature. Consequently, the yarn 11, as it leaves the heated enclosure 10 at elevated temperature, has been rapidly cooled by this air in interlacing jet 12, so the interlaced yarn 13 has been significantly colder than this yarn 11, and the interlaced yarn 13 has accordingly been wound to form a package at a correspondingly colder temperature than that of the yarn 11 that has just emerged from the heated enclosure 10.

According to the present invention, however, this conventional process is modified so that the yarn 13 is maintained at an elevated temperature as it is advanced through the winding step. This is preferably effected by using heated air in jet 12 to avoid cooling the yarn 11, so the interlaced yarn 13 is maintained at an elevated temperature as it is wound into a package. The precise temperature conditions will vary according to the particular process and apparatus used. Insulation of the yarn path from the relaxation step through the step of winding the package may be provided to avoid or reduce the cooling effect of atmospheric air.

Although the invention is not limited to any particular theory, it is believed that avoiding or reducing cooling of the yarn leaving the annealing enclosure has a beneficial effect on the relaxation step in the sense that the reduction in shrinkage is continued over a period of time without the usual reduction of tenacity, possibly because maintaining the relaxed yarn at an elevated temperature over this period of time enables crystallization to continue, with an increase in the average crystal size. Possibly this occurs instead of reducing orientation (which would reduce strength and modulus) by following the prior art technique of increasing the degree of overfeed during relaxation. Thus, the duration for which the elevated temperature is continued appears to be of importance, as well as the actual temperature, and the precise critical limits may well depend on the nature of the polymeric yarn, which would depend on the relative viscosity of the polymer and on the speeds at which the filaments are processed, especially the spinning (withdrawal) speed. This could also explain why it has been possible to prepare yarns having a better balance of high strength and low shrinkage by the less economical split process, which is performed at lower speeds usually without interlacing between relaxation and windup.

The improvement in balance of properties over that obtainable by other coupled techniques is evident from the comparison in the following Example.

Example 1

Several yarns of 1000 denier, 140 filaments, 37 R.V., were made using (except for item B) a process and apparatus essentially as described above and illustrated schematically in FIG. 1, and a draw roll speed of 3100 ypm (2835 meters/min), but with differing degrees of relaxation, and consequently differing wind-up speeds. The properties were measured as described hereinafter and are shown in Table 1. The processes varied in the following essential respects:

A is a conventional process, using a steam jet at 360° C. for the heater 6, and a draw ratio of 5.9X between draw roll 8 and feed roll 5, heating rolls 8 and 9 to 240° C. within enclosure 10, overfeeding the yarn 9.1% between roll 9 and wind-up roll 14, so that the wind-up speed is 2820 ypm (about 2580 meters/min), and using interlacing air at 50 psi and at room temperature (about 30° C.) in jet 12. As shown in Table 1, the tensile properties are excellent, but the shrinkage (DHS) and shrinkage tension are undesirably high.

B is a commercial yarn made by a competitor, and so the process conditions are not known. Table 1 shows that the shrinkage and shrinkage tension are significantly lower than those of item A, but at the expense of a significant and undesired reduction also in tenacity.

C uses a method of reducing shrinkage that is known in the art. The difference from A is that the overfeed between roll 9 and wind-up roll 14 is 13.5%, so the wind-up speed is 2680 ypm (about 2450 meters/min). To avoid consequent overentanglement of the filaments, the pressure of the interlacing air was reduced to 45 psi and the jet was modified slightly. As shown in Table 1, this modification has not reduced the tenacity as much as for item B. Although the tenacity remains at a desirably high level, the shrinkage and shrinkage tension have not, however, been reduced as much as in item B.

D is similar, but uses an even larger overfeed between roll 9 and wind-up roll 14 so the wind-up speed is 2600 ypm (about 2375 meters/min), and thereby succeeds in reducing the shrinkage and shrinkage tension dramatically, but has the defect of reducing tenacity to an undesirable extent, less than 7.5 gpd.

Figure 2:
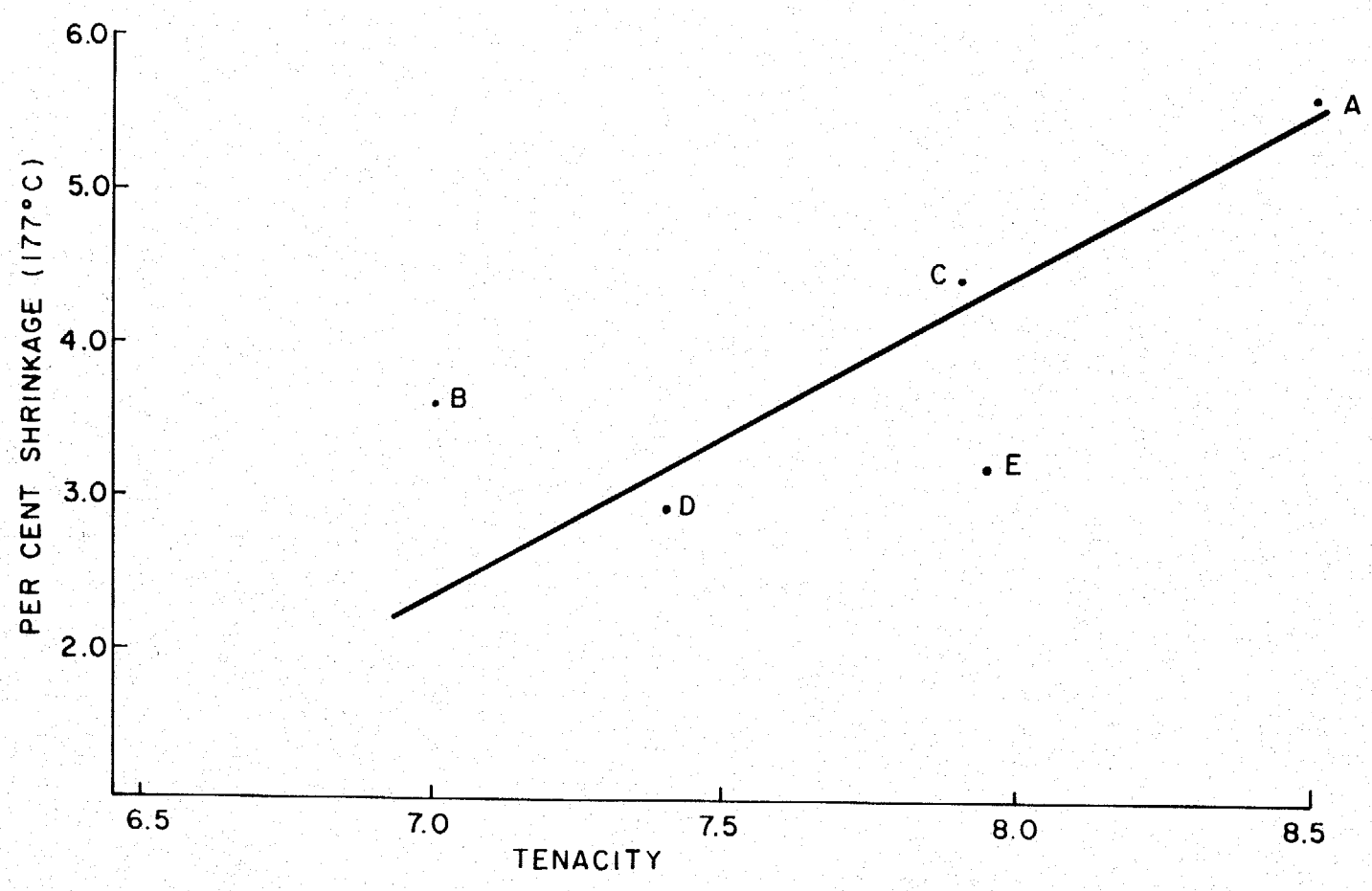
FIG. 2 and FIG. 3 are graphs that are explained in the Example.

It will be noted that there is a roughly linear relationship between reduction of tenacity and decrease of shrinkage obtained merely by increase of overfeed, as shown in FIG. 2, for yarn Samples A, C and D spun and drawn under these conditions, so that, hitherto, the desired combination of tenacity of about 8 gpd and shrinkage of not more than 3.5% has not been obtainable by this approach. All the above tests have been comparisons, and have not been according to the invention.

E is according to the invention, and is like C except that the interlace air in jet 12 was heated to a temperature of 160° C. The resulting yarn has significantly the best balance of shrinkage and tensile properties shown in the Table. The tenacity is significantly above those of B and D, but with the shrinkage $DHS_{140}$, and shrinkage tension $ST_{140}$ at the lowest values in the Table.

desirably located well apart from the linear relationship of Samples A, C and D.

Figure 3:
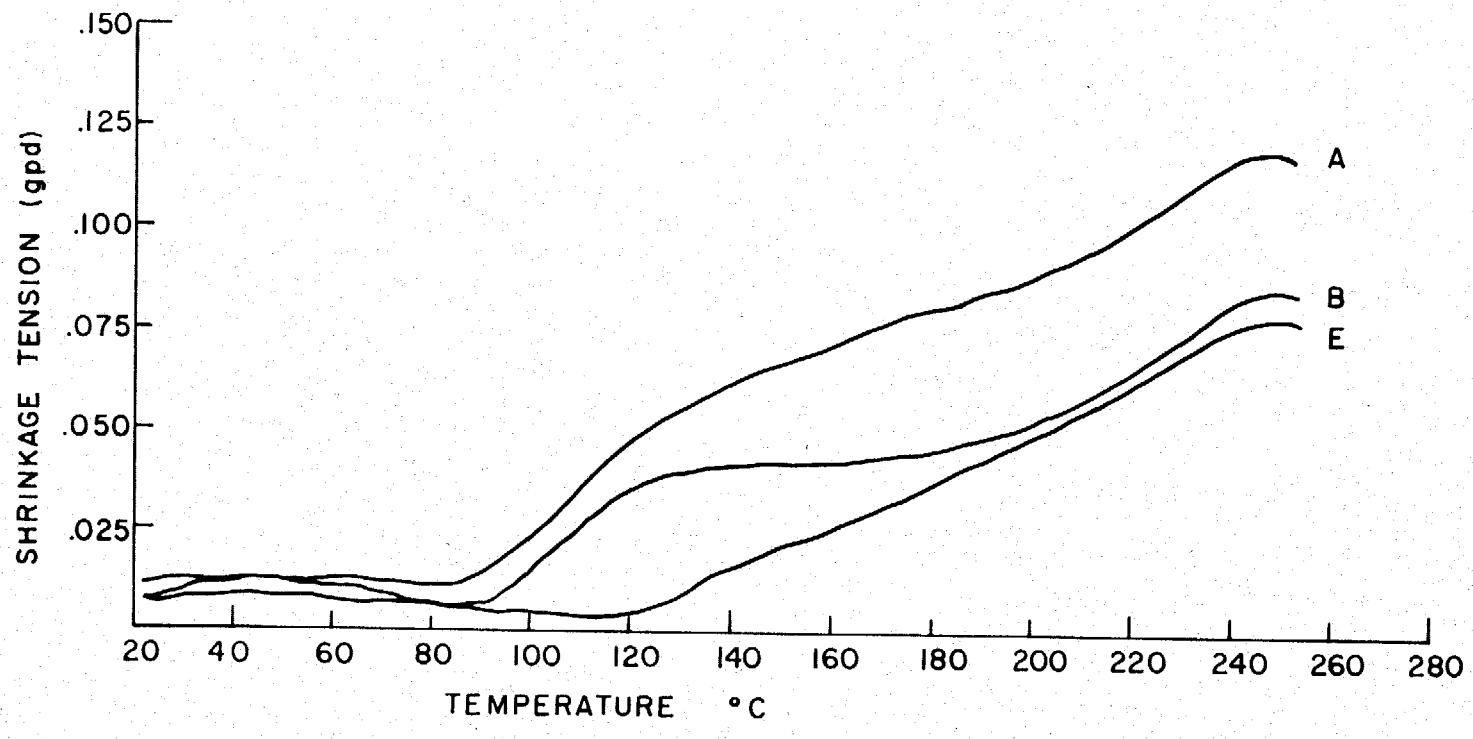

The significant difference in shrinkage tension is visible from FIG. 3, which plots shrinkage tension against temperature for Samples A, B and E. A low shrinkage tension is highly desirable when hot-coating fabrics of industrial polyester yarns at temperatures of about 140° C. The different slopes and locations of the B and E curves at such temperatures can be noted, while at higher temperatures (e.g. 200°) the values are much closer together. This graph shows that measurement of only the peak shrinkage tension could show little significant difference, and so obscure the very real difference between the behavior of Samples B and E in commercial practice.

I have found the uniformity of the shrinkage ($DHS_{177}$) of Sample E to be very impressive, as compared with prior commercial yarns. Sample A has been noted to have a Standard Deviation (SD) of $DHS_{177}$ of 0.33, which has been considered excellent hitherto. The SD on 90 packages of Sample E has been only 0.17, which indicates a surprising improvement in uniformity, which could prove a very significant practical advantage.

The Sample E has processed well in a standard weaving process and has given a very acceptable coated fabric by a hot coating technique. This coated fabric has been wider, smoother (less broken filaments) and non-

TABLE 1

| Sample | T gpd | $E_5$ % | $E_B$ % | DHS (%) 140° | DHS (%) 177° | Shrinkage Tension (gpd) 100° | 120° | 140° | 160° | 180° | 200° | 240° | Peak | Interlace cm |
|---|---|---|---|---|---|---|---|---|---|---|---|---|---|---|
| A | 8.5 | 6.7 | 23 | 2.6 | 5.6 | .021 | 044 | .060 | .069 | .077 | .086 | .111 | .114 | 5 |
| B | 7.0 | 9.6 | 28 | 2.2 | 3.6 | .012 | .036 | .041 | .042 | .046 | .051 | .079 | .085 | 8 |
| C | 7.8 | 9.5 | 27 | 2.5 | 4.2 | .016 | .034 | .054 | .063 | .074 | .078 | .082 | .085 | 12 |
| D | 7.4 | 11.2 | 31 | 1.7 | 2.9 | .006 | .021 | .029 | .036 | .038 | .048 | .059 | .065 | 9 |
| E | 7.9 | 9.5 | 28 | 1.4 | 3.1 | .007 | .006 | .017 | .026 | .036 | .049 | .073 | .077 | 19 |

It was surprising to find that such a slight process difference was sufficient to achieve the desired objective, since the cooling caused by the interlace air may not seem very dramatic, even by hindsight. On measuring the temperature of yarn wound on the packages after interlacing with air at 30° C., this temperature was found to be about 83° C., whereas switching off the interlace air produced yarn wound at 93° C., and this yarn was found to have the desired balance of high tenacity with low shrinkage properties (but was not coherent, being without interlace). Varying the temperature of the air used for interlacing between 100° C. and 200° C. did not appear to affect the properties of the interlaced yarn significantly.

The annealing temperature range (heating after drawing in enclosure 10) is preferably 200° to 260° C. especially 235° to 255° C. The amount of overfeed (between roll 9 and wind-up roll 14) is preferably about 10 to 15%. The precise values may be optimized according to the particular polymer and process conditions. As indicated in the Example, some minor modifications may be required for the interlacing process, such as reduction of air pressure, and modifications of the jet, to optimize the properties of the resulting yarns, and particularly to minimize overentanglement at these higher overfeeds, and any broken filaments that may result.

The surprising combination of desirably low shrinkage without significant reduction in tenacity of Sample E, in contrast to the other Samples, is shown conveniently in FIG. 2, which demonstrates that Sample E is puckered as contrasted with coated fabrics obtained from prior art Samples A and B. These are important desirable characteristics in commercial practice, because they lead to a better fabric yield, i.e., more coated fabric of first-grade in full width.

The flex life (measured by standard techniques) of Sample E has also been consistently higher than that of Sample A or Sample B, and also higher than that of commercial yarns believed to have been made by the split process.

All temperatures are measured in °C.

Tensile properties are determined by means of an Instron Tensile Tester Model 1122 which extends a 10-inch (25 cm) long yarn sample to its breaking point at an extension rate of 12 inch/min (30 cm/min) at a temperature of about 25°. Extension and breaking load are automatically recorded on a stress-strain trace. Tenacity is the breaking load in grams divided by the original denier. $E_B$ is the percentage extension at break. $E_5$ is the elongation at a load of 2.3 gpd (equivalent to 5 pounds for a yarn of 1000 denier) and may be obtained from the stress-strain trace; $E_5$ is a convenient measure of the yarn modulus in the sense of the resistance of the yarn to extension under the type of load encountered in normal processing operations.

Dry Heat Shrinkages are determined by exposing a measured length of yarn under zero tension to dry heat for 30 minutes in an oven maintained at the indicated temperatures (177° for $DHS_{177}$ and 140° for $DHS_{140}$)

and by measuring the change in length. The shrinkages are expressed as percentages of the original length. $DHS_{177}$ has been most frequently measured for industrial yarns, but I have found $DHS_{140}$ to give a better indication of the shrinkage that industrial yarns actually undergo during commercial coating operations, although the precise conditions vary according to proprietary processes.

The standard deviation (SD) is a commonly used statistical term and is defined as the positive square root of the variance. The variance is the sum of the squares of the deviations of individual measurements from the sample mean, divided by one less than the number of measurements.

The shrinkage tension (ST) is measured using a shrinkage tension-temperature spectrometer (The Industrial Electronics Co.) equipped with a Stratham Load Cell (Model UL4-0.5) and a Stratham Universal Transducing CEU Model UC3 (Gold Cell) on a 10 cm loop held at constant length under an initial load of 0.005 gpd and heated in an oven at 30° C. per minute. This provides a trace of the type indicated for each curve in FIG. 3, and the shrinkage tension values can be read off at any desired temperature.

Interlace is measured as the pin count, given in cm, by a Rothschild entanglement tester. A fine needle is instrumentally inserted through the threadline. The threadline is drawn across the needle at 480 cm/min. under 10 grams of tension. When an interlace entanglement is encountered by the needle, the yarn tension increases. Each time the yarn tension increases to greater than 30 grams, this point is registered as an interlace node. The distance in cm between the interlace nodes is recorded. The average of 10 such distances is reported as the interlace pin count.

Any Relative Viscosity (RV) measurement referred to herein is the ratio of the viscosity of a 4.47 weight on weight percent solution of the polymer in hexafluoroisopropanol containing 100 ppm sulfuric acid to the viscosity of the solvent at 25° C. Using this solvent, the industrial yarns in the prior art, such as U.S. Pat. No. 3,216,817, have relative viscosities of at least 35.

It will also be understood that the process of the invention can be applied with advantage to polyester textile yarns of lower relative viscosity, to give improved polyester textile filament yarns of improved properties. Although other methods of preparing low shrinkage yarns are available, the improvement in uniformity may be expected to be of commercial importance. Accordingly, there is also provided, according to the present invention, an improved coupled process of preparing drawn interlaced polyester yarns involving the steps of spinning molten poly(ethylene terephthalate) to form a multifilament yarn, advancing the yarn while drawing at an elevated temperature to increase its strength, heating the drawn yarn and overfeeding it to reduce its shrinkage, including a step of interlacing the yarn to provide coherency, and winding the drawn interlaced yarn at a speed of at least 1800 ypm to form a package in a continuous process, the improvement characterized in that the temperature of the yarn is maintained above about 90° C. until completing winding the yarn package.

I claim:

1. An interlaced poly(ethylene terephthalate) industrial yarn of relative viscosity at least about 35, and having a combination of high strength and low shrinkage as determined by a dry heat shrinkage $DHS_{177}$ (measured at 177° C.) of from about 3.5% to about 2.0%, a dry heat shrinkage $DHS_{140}$ (measured at 140° C.) of from about 2.0% to about 1.0%, a shrinkage tension $ST_{140}$ (measured at 140° C.) of from about 0.03 to about 0.01 gpd, a tenacity of from about 7.7 to about 8.5 gpd, and an elongation $E_5$ (measured at a load of 2.3 gpd) of from about 8% to about 10%.

2. A yarn according to claim 1, wherein the standard deviation of the dry heat shrinkage $DHS_{177}$ is about 0.30 or less.

3. A yarn according to claim 2, wherein the said standard deviation is less than about 0.20.

4. A yarn according to claim 1, wherein the dry heat shrinkage $DHS_{177}$ is from about 3.2% to about 2.0%.

5. A yarn according to claim 1, wherein the standard deviation of the dry heat shrinkage $DHS_{177}$ is about 0.30 or less.

6. A yarn according to claim 5, wherein the said standard deviation is less than about 0.20.

7. A yarn according to claim 1, wherein the dry heat shrinkage $DHS_{140}$ is from about 1.6% to about 1.0%.

8. A yarn according to claim 1, wherein the shrinkage tension $ST_{140}$ is from about 0.02 gpd to about 0.01 gpd.

9. An interlaced poly(ethylene terephthalate) industrial yarn of relative viscosity at least about 35, and having a combination of high strength and low shrinkage as determined by a dry heat shrinkage $DHS_{177}$ (measured at 177° C.) of from about 3.2% to about 2.0%, a dry heat shrinkage $DHS_{140}$ (measured at 140° C.) of from about 1.6% to about 1.0%, a shrinkage tension $ST_{140}$ (measured at 140° C.) of from about 0.02 to about 0.01 gpd, a tenac1ty of from about 7.7 to about 8.5 gpd, and an elongation $E_5$ (measured at a load of 2.3 gpd) of from about 8% to about 10%.

10. A yarn according to claim 9, wherein the standard deviation of the dry heat shrinkage $DHS_{177}$ is about 0.30 or less.

11. A yarn according to claim 10, wherein the said standard deviation is less than about 0.20.

* * * * *